US006118382A

United States Patent [19]

Hibbs et al.

[11] Patent Number: 6,118,382

[45] Date of Patent: Sep. 12, 2000

[54] SYSTEM AND METHOD FOR ALERTING SAFETY PERSONNEL OF UNSAFE AIR TEMPERATURE CONDITIONS

[75] Inventors: James D. Hibbs, Smithville; John W. Brodhecker, Leander, both of Tex.

[73] Assignee: FireEye Development, Incorporated, Austin, Tex.

[21] Appl. No.: 09/182,823

[22] Filed: Oct. 29, 1998

Related U.S. Application Data

[60] Provisional application No. 60/064,324, Oct. 30, 1997.

[51] Int. Cl.[7] ..... G08B 17/00

[52] U.S. Cl. ..... 340/586; 340/584; 340/573.1; 340/691.1

[58] Field of Search ..... 340/586, 573.1, 340/584, 626, 632, 691.1; 128/205.23, 200.24, 204.26, 205.22, 205.25, 201.24, 201.15, 202.24, 202.27; 2/428, 435, 436, 5

[56] References Cited

U.S. PATENT DOCUMENTS

| | | | |
|---|---|---|---|
| 4,727,359 | 2/1988 | Yuchi et al. | 340/518 |
| 4,996,981 | 3/1991 | Elenewski et al. | 128/201.15 |
| 5,157,378 | 10/1992 | Stumberg et al. | 340/521 |
| 5,200,736 | 4/1993 | Coombs et al. | 340/586 |
| 5,301,668 | 4/1994 | Hales | 128/205.23 |
| 5,398,023 | 3/1995 | Murray | 340/825.44 |
| 5,541,579 | 7/1996 | Kiernan | 340/573.1 |
| 5,635,909 | 6/1997 | Cole | 340/586 |
| 5,640,148 | 6/1997 | Lewis et al. | 340/573.1 |
| 5,659,296 | 8/1997 | Debe et al. | 340/632 |
| 5,689,234 | 11/1997 | Stumberg et al. | 340/521 |
| 5,691,707 | 11/1997 | Smith et al. | 340/682 |
| 5,781,118 | 7/1998 | Wise et al. | 340/632 |
| 5,917,416 | 6/1999 | Read | 340/584 |
| 5,973,602 | 10/1999 | Cole, III et al. | 340/584 |

*Primary Examiner*—Benjamin C. Lee
*Attorney, Agent, or Firm*—Baker Botts L.L.P.

[57] ABSTRACT

A system and method are disclosed for alerting safety personnel of unsafe air temperature conditions. The system includes a temperature sensor formed to be exposed to an ambient environment and operable to provide a signal representing a measured ambient temperature. The system also includes electronics formed to be attached within protection provided by safety equipment. The electronics are coupled to receive the signal from the temperature sensor. The electronics are then operable to process the signal, to detect an unsafe temperature condition and to provide an indicator signal responsive to the unsafe temperature condition. The system further includes an indicator coupled to receive the indicator signal from the electronics. The indicator then responds to the indicator signal by providing a visible indication of the unsafe temperature condition. In certain implementations, the unsafe temperature condition can comprise the measured ambient temperature being above a temperature set point or being above a specified temperature for a specified period of time. Further, the temperature sensor can be coupled to the electronics by a through-screw sensor assembly.

21 Claims, 5 Drawing Sheets

SYSTEM AND METHOD FOR ALERTING SAFETY PERSONNEL OF UNSAFE AIR TEMPERATURE CONDITIONS

CROSS-REFERENCE TO RELATED APPLICATIONS

This application claims priority to U.S. Provisional Patent Application 60/064,324, filed Oct. 30, 1997, pending.

TECHNICAL FIELD OF THE INVENTION

The present invention relates in general to the field of equipment for firefighters and other safety personnel, and, more particularly, to a system and method for alerting safety personnel of unsafe air temperature conditions.

BACKGROUND OF THE INVENTION

Firefighters and other safety personnel use various types of equipment when fighting a fire. This equipment typically includes a coat, boots, gloves and other clothing specially created to protect against fire and heat as well as a self contained breathing apparatus to provide oxygen. Although such equipment provides some protection, firefighter's still face significant dangers including the danger of a flashover. In general, once the ambient temperature in a fire reaches about 600 degrees Fahrenheit, the temperature will quickly rise to over 1100 degrees Fahrenheit. At this point, a flashover can occur in which the air ignites and kills or severely injures firefighters. Thus, it is unsafe to fight fires once the ambient temperature reaches around 600 degrees Fahrenheit.

To alleviate some of the dangers involved in firefighting, various electronic devices have been developed to provide warnings to firefighters. For example, U.S. Pat. No. 5,640,148 discloses a dual activation alarm system for a personal alert safety system (PASS). U.S. Pat. No. 5,635,909 discloses a temperature monitoring assembly that is incorporated into a garment such as a coat. This device includes a speaker to provide an audible alarm. U.S. Pat. No. 5,541,549 discloses a personal alarm safety system that is designed as part of the firefighter's belt. Further, U.S. Pat. No. 5,137,378 discloses an integrated firefighter safety monitoring and alarm system that provides a number of warnings to a firefighter. This system includes temperature monitoring and provides an audible alarm. The system also has a display for providing additional information to the firefighter including a visible warning. The system is contained in a case that can have a belt or mounting clip for attaching to the firefighter's equipment.

However, even with such conventional devices, firefighters are still injured or killed by flashovers. The complexity of the conventional devices, the difficulties of the firefighting environment and the type and location of the warnings cause firefighters not to hear audible warnings or not to see visible warnings of dangerous ambient temperatures.

SUMMARY OF THE INVENTION

In accordance with the present invention, a system and method for alerting safety personnel of unsafe air temperature conditions are disclosed that provide advantages over previously developed temperature warning equipment.

According to one aspect of the present invention, the present system includes a temperature sensor formed to be exposed to an ambient environment and operable to provide a signal representing a measured ambient temperature. The system also includes electronics formed to be attached within protection provided by safety equipment. The electronics are coupled to receive the signal from the temperature sensor. The electronics are then operable to process the signal, to detect an unsafe temperature condition and to provide an indicator signal responsive to the unsafe temperature condition. The system further includes an indicator coupled to receive the indicator signal from the electronics. The indicator then responds to the indicator signal by providing a visible indication of the unsafe temperature condition. In certain implementations, the unsafe temperature condition can comprise the measured ambient temperature being above a temperature set point or being above a specified temperature for a specified period of time. Further, the temperature sensor can be coupled to the electronics by a through-screw sensor assembly.

According to another aspect of the present invention, a method is disclosed for alerting safety personnel of unsafe air temperature conditions. The method includes measuring ambient temperature and detecting an unsafe temperature condition. Then, a visible indication of the unsafe temperature condition is provided within the peripheral vision of safety personnel.

A technical advantage of the present invention is the providing of indicators and/or alarms to safety personnel focused upon the personal safety of the firefighter. The trigger points, rather than being focused on equipment safety, focus upon the safety personnel.

Another technical advantage of the present invention is the ease of use in that the temperature indicators are positioned within the personnel's peripheral vision near the face mask of a self contained breathing apparatus. The present invention can help save lives by providing a passively visible warning that the environment is approaching flashover conditions. Further, the present invention may save on taxpayer's funds that would have otherwise been spent on fire suit replacements, compensation packages and downtime costs.

Additional technical advantages should be readily apparent from the drawings, description, and claims.

BRIEF DESCRIPTION OF THE DRAWINGS

A more complete understanding of the present invention and advantages thereof may be acquired by referring to the following description taken in conjunction with the accompanying drawings in which like reference numbers indicate like features and wherein.

DETAILED DESCRIPTION OF THE INVENTION

Figure 1:
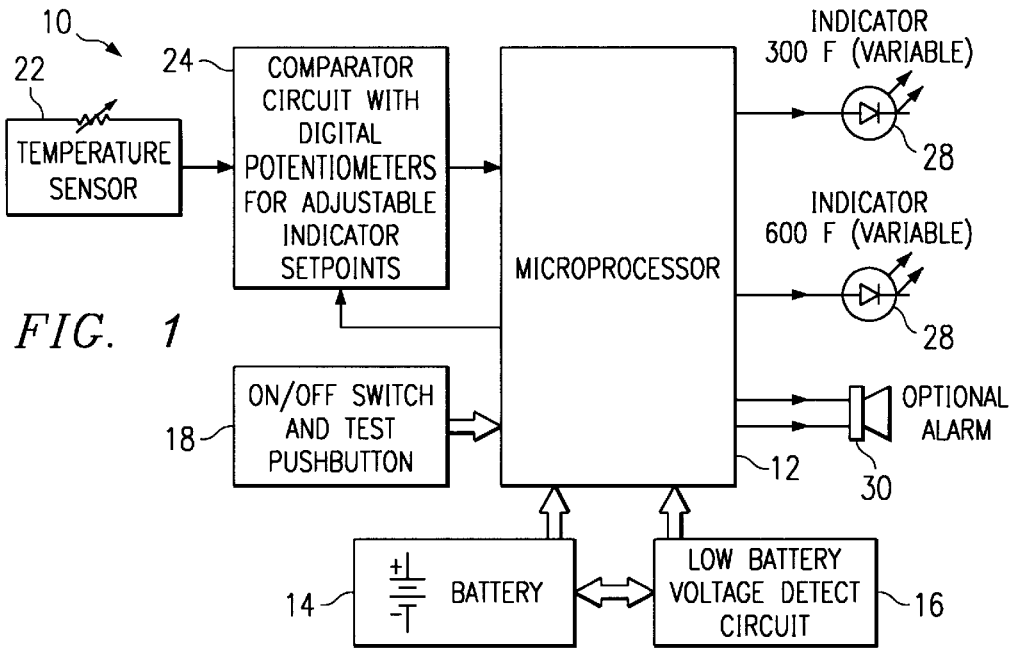
FIG. 1 is a block diagram of one embodiment of a system for alerting safety personnel of unsafe air temperature conditions constructed according to the present invention.

FIG. 1 is a block diagram of one embodiment of a system, indicated generally at 10, for alerting safety personnel of unsafe air temperature conditions constructed according to the present invention. As shown, system 10 has a microprocessor 12 that receives power from a battery 14. Microprocessor 12 serves as a control unit for system 10, which control unit, it should be understood, could comprise other types of control devices. Battery 14 can be replaced by the user and can be conserved by switching system 10 off when not in use. System 10 also includes a low battery voltage detect circuit 16 and can be turned on and off by an on/off switch 18 and test push-button 18. This switch 18 can be backed up by an automatic switch (not shown) that turns system 10 on when the ambient temperature reaches a certain point, such as is 150 degrees Fahrenheit.

A temperature sensor 22 measures temperature and provides an output to a comparator circuit 24 which has digital potentiometers for adjustable indicator set points. Temperature sensor 22 can, for example, be a resistive temperature device (RTD), thermocouple, thermistor or infra-red (IR) sensor. In the embodiment of FIG. 1, system 10 has dual thresholds, but it should be understood that more thresholds could be implemented if appropriate. Also, in the embodiment of FIG. 1, digital potentiometers can be set by signals from microprocessor 12.

In operation, comparator circuit 24 provides a signal to microprocessor 12 in response to a comparison between the digital potentiometers and the output from temperature sensor 22. Microprocessor 12 then provides signals to drive two visible indicators 28, as shown. These visible indicators 28 can, for example, be LED, LCD, heads-up-display, fiber optic or incandescent indicators. In the illustrated embodiment, visible indicators 28 are LED's and indicate an ambient temperature of 300 degrees Fahrenheit and 600 degrees Fahrenheit, respectively. However, these settings are variable and could be other values. Further microprocessor 12 can provide signals to an optional alarm 30. The alarm can, for example, be an audible or vibration alarm.

The microprocessor control of system 10 can provide additional enhancements to temperature monitoring for the safety of safety personnel. For example, system 10 can utilize time averaged measurements for additional or alternate indicators. Such time averaged measurements identify the fact that the safety personnel has been at a given ambient temperature for a given amount of time. Examples of time averaged measurements include: 160 degrees Fahrenheit for 60 seconds, 180 degrees Fahrenheit for 30 seconds, 212 degrees Fahrenheit for 15 seconds, and 500 degrees Fahrenheit for 60 seconds. System 10 can react to such events by providing additional visible indicators and alarms. Another enhanced feature is an ability to record and provide a temperature history for a post-event analysis. For example, the temperature could be recorded at specified intervals of time while the firefighter or other safety personnel is working to give an idea of the temperature profile within the site. Further, this could be linked with positioning information, such as from GPS equipment, to "map" the temperature gradients within the site. The recording can, for example, be into on-board random access memory.

One purpose of system 10 is to provide firefighter and other safety personnel with an early warning of excessive temperatures that would eventually lead to a flashover or other danger. In general, once the ambient temperature in a fire reaches 300 degrees Fahrenheit, the temperature will start rising, and it takes around 2 minutes, linearly, to reach 600 degrees Fahrenheit. Once the temperature reaches that threshold, the temperature will start rising exponentially to over 1100 degrees Fahrenheit in less than a minute. This fatal phenomenon is termed a flashover. It is appropriate to evacuate buildings or other structures once the temperature reaches around 600 degrees Fahrenheit. Further, other temperature related conditions can be unsafe for firefighters. For example, as mentioned above, remaining in a high ambient temperature for a certain period of time can be dangerous.

In one implementation, the present invention provides a system that generally incorporates a remote temperature sensing device encapsulated with batteries and indicators (e.g., green and red LED's) within an insulated enclosure which is mounted within the peripheral vision of the self-contained breathing apparatus (SCBA) that firefighters wear. The green and red LED's will glow the moment the ambient temperature rises above 300 degrees Fahrenheit or 600 degrees Fahrenheit, respectively. This early signaling will afford firefighters with ample time to react to the situation and make informed decisions as to whether to proceed or revert. Not only will the present invention save many firefighter's lives, but, in turn, will also save on taxpayer's funds that would have otherwise been spent on fire suit replacements, firefighter's compensation packages and downtime costs.

Figure 2:
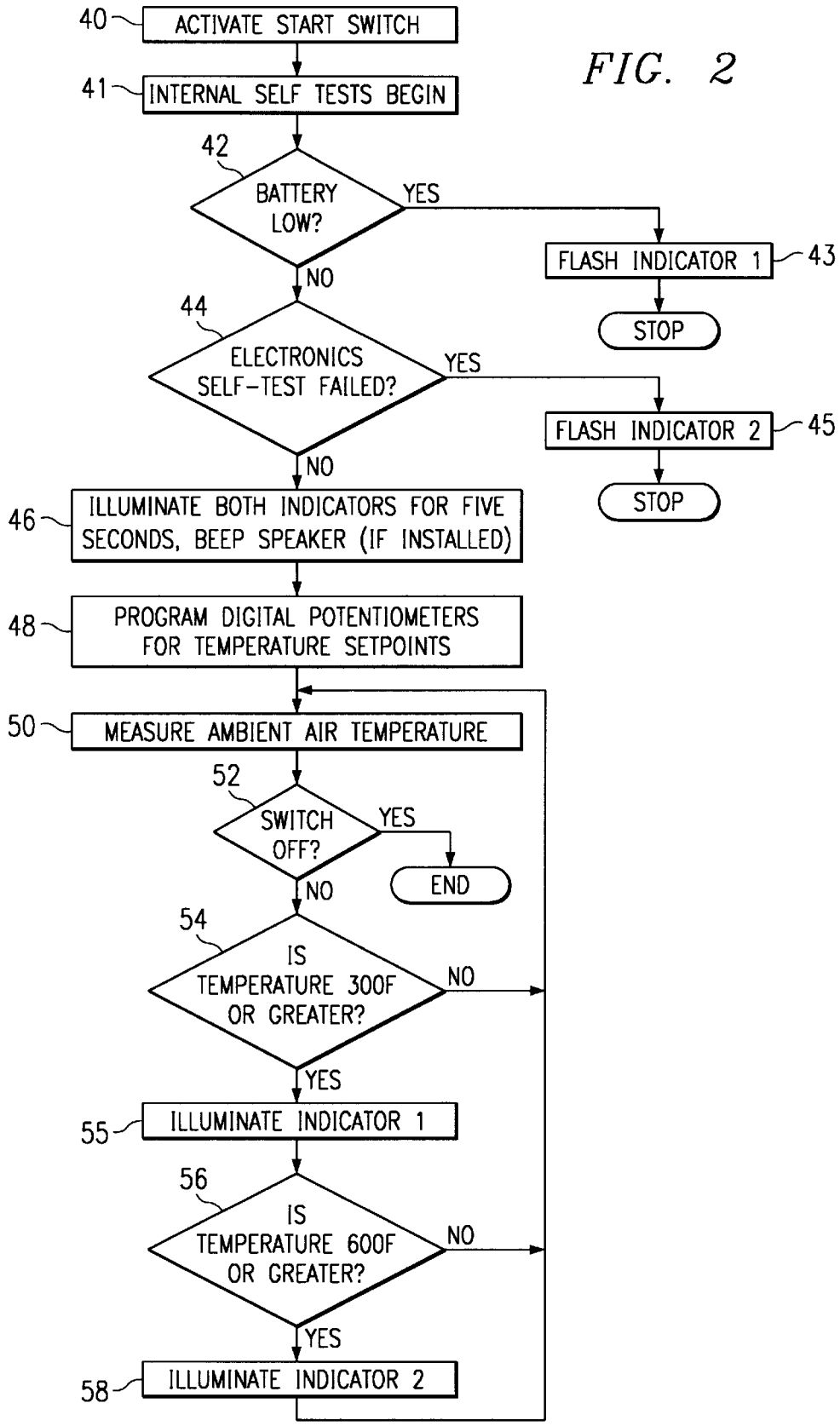
FIG. 2 is a flow chart of one embodiment of a method for alerting safety personnel of unsafe air temperature conditions according to the present invention.

FIG. 2 is a flow chart of one embodiment of a method for alerting safety personnel of unsafe air temperature conditions according to the present invention. As shown, in step 40, the start switch is activated. This activation can be manual or automatic as mentioned above. Then, in step 41, the system begins an internal self test. In step 42, the system checks whether the battery is low. If so, in step 43, the system flashes one of the indicators to signal the problem. In step 44, the system determines whether the self-test failed. If so, in step 45, the system flashes the other indicator to signal this failure. If the tests do not fail, in step 46, the system illuminates both indicators for five seconds and beeps the installed speaker (if any).

In step 48, the system then allows a user to program the digital potentiometers for the temperature set points. This can be an optional step if the digital potentiometers are already set. Then, in step 50, the system measures the ambient temperature on an ongoing basis using the temperature sensor. In step 52, the system determines it is switched off. If so, then the process stops. Otherwise, the system checks, in step 54, whether the temperature is at the first set point (e.g., 300 degrees Fahrenheit) or greater. If not, then the system returns to measuring the temperature. If the temperature is greater than 300 degrees Fahrenheit, then the system illuminates the first indicator in step 55. Then, in step 56, the system checks whether the temperature is greater than the second set point (e.g, 600 degrees Fahrenheit). If not, the system returns to measuring the temperature of step 50. If the temperature is greater than 600 degrees Fahrenheit, then the system illuminates the second indicator in step 58 and then returns to measure temperature, as shown. In this manner, the system continually monitors the ambient temperature and provides a visible warning of the ambient temperature is above either of the temperature set points. It should be understood that other implementations would include other steps. For example, an implementation having time averaged measurements would involve steps for averaging temperature over a specified interval of time and alerting a firefighter or other safety personnel when certain conditions have been met.

Figure 3:
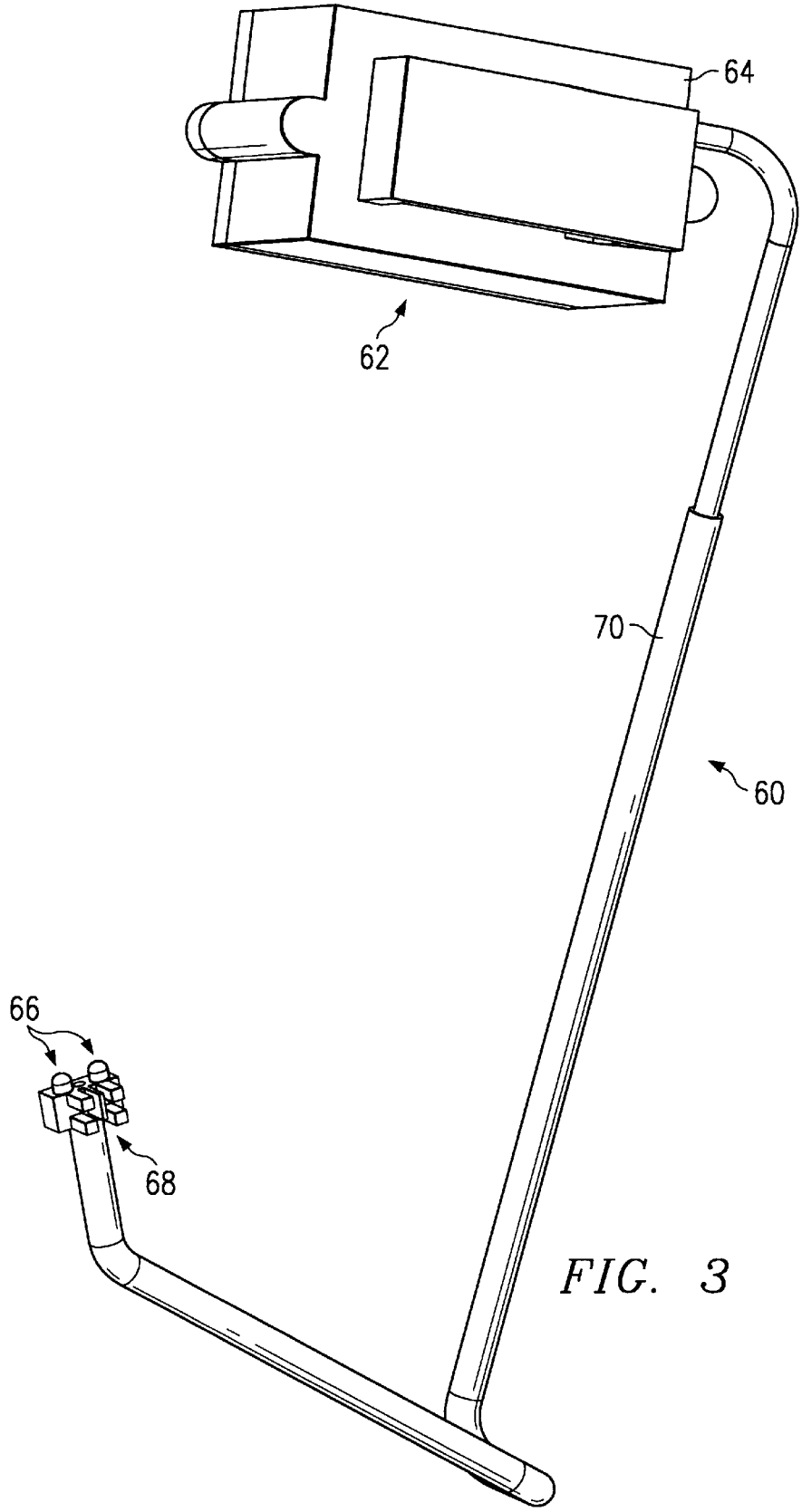
FIG. 3 is a perspective view of one embodiment of a system for alerting safety personnel of unsafe air temperature conditions constructed according to the present invention.

FIG. 3 is a perspective view of one embodiment of an system, indicated generally at 60, for alerting safety personnel of unsafe air temperature conditions constructed according to the present invention. As shown, system 60 comprises electronics 62 that are contained primarily in a housing 64 with the exception of visible indicators 66 and a sensor 68 which are positioned at the end of an arm 70 extending from housing 64. In this embodiment, sensor 68 and indicators 66 on arm 70 can be exposed to the ambient temperatures, while the remaining portions of system 60 are protected within the firefighters equipment. Further, this allows the sensor 68 and indicators 66 to be easily replaceable with a detachable arm 70. Electronics 62 can be implemented, for example, according to the block diagram of FIG. 1, above.

Figure 4:
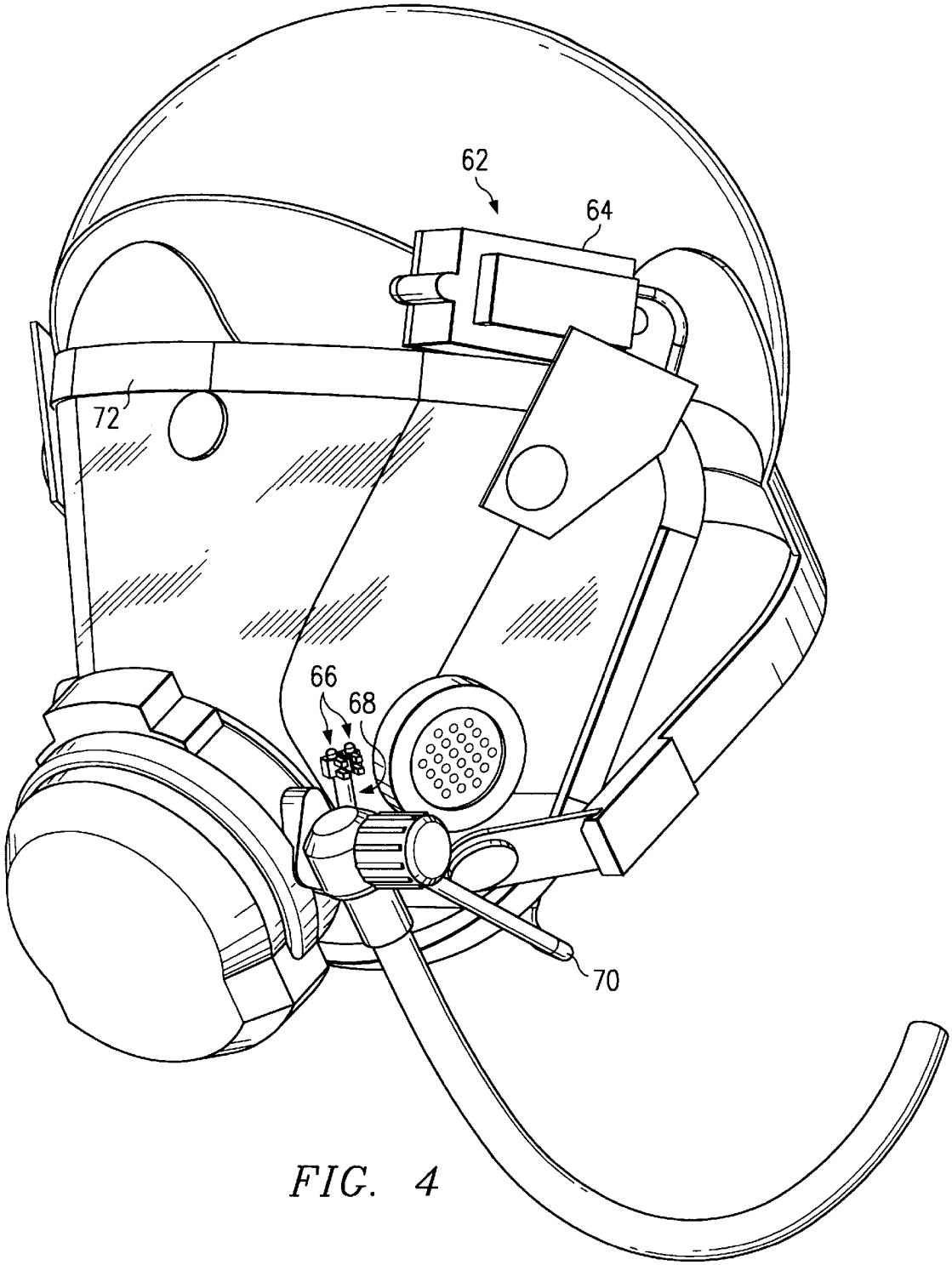
FIG. 4 is a perspective view of one embodiment of the system of FIG. 3 affixed to a self contained breathing apparatus face piece according to the present invention.

FIG. 4 is a perspective view of one embodiment of system 60 of FIG. 3 affixed to a self contained breathing apparatus face piece 72 according to the present invention. As shown, housing 64 of system 60 is attached to face piece 72 which is coupled to a firefighter's helmet. A arm 70 then extends from housing 64 and positions indicators 66 within the peripheral vision of the firefighter. In this manner, the firefighter can passively see indicators 66 without actively having to look away or otherwise take attention away from firefighting tasks.

According to the present invention, system 60 can be a completely self-contained unit attached to the firefighter's self-contained breathing apparatus (SCBA) face piece 72. System 60 operates to alert a firefighter when the ambient temperature has reached an unsafe level, for example, that would lead to a flashover. System 60 can be mounted in a fashion such that indicators 66 (e.g., LEDs), which turn on at pre-determined temperatures are other defined conditions, lie within the firefighter's peripheral vision.

As shown above, a switch can turn system 60 on and also can serve as a daily test button. A successful self-test can illuminate indicators 66, then turn them off and allow a speaker to beep (if present). If there is a problem with electronics 62, indicators 38 can flash an error sequence when system 60 is switched on. Also, the power switch can be backed up by an automatic switch that turns system 60 on when the ambient temperature reaches a specified point.

According to the present invention, visible indicators are placed in the field of view, for example, while a firefighter is fighting a fire. When the ambient temperature reaches a first set point (e.g., 300° F.), the first indicator will be illuminated and will stay on as long as the temperature is at the set point or above. When the ambient temperature reaches the second set point (e.g., 600° F.), the second indicator will illuminate and will stay on as long as the temperature is at that set point or above. The second indicator can indicate that there is a very short time period before temperatures reach a point at which flashover could occur. At this point, the firefighter (or other personnel) should consider immediately leaving the area to avoid a life threatening situation. Since the set points can be predetermined, the first set point can be set at the face piece manufacturer's suggested temperature rating for the normal functioning of the face piece to serve as an equipment failure warning. As mentioned above, the temperature set points can be varied by reprogramming of the digital potentiometers to provide alerts as to other unsafe conditions.

Figure 5:
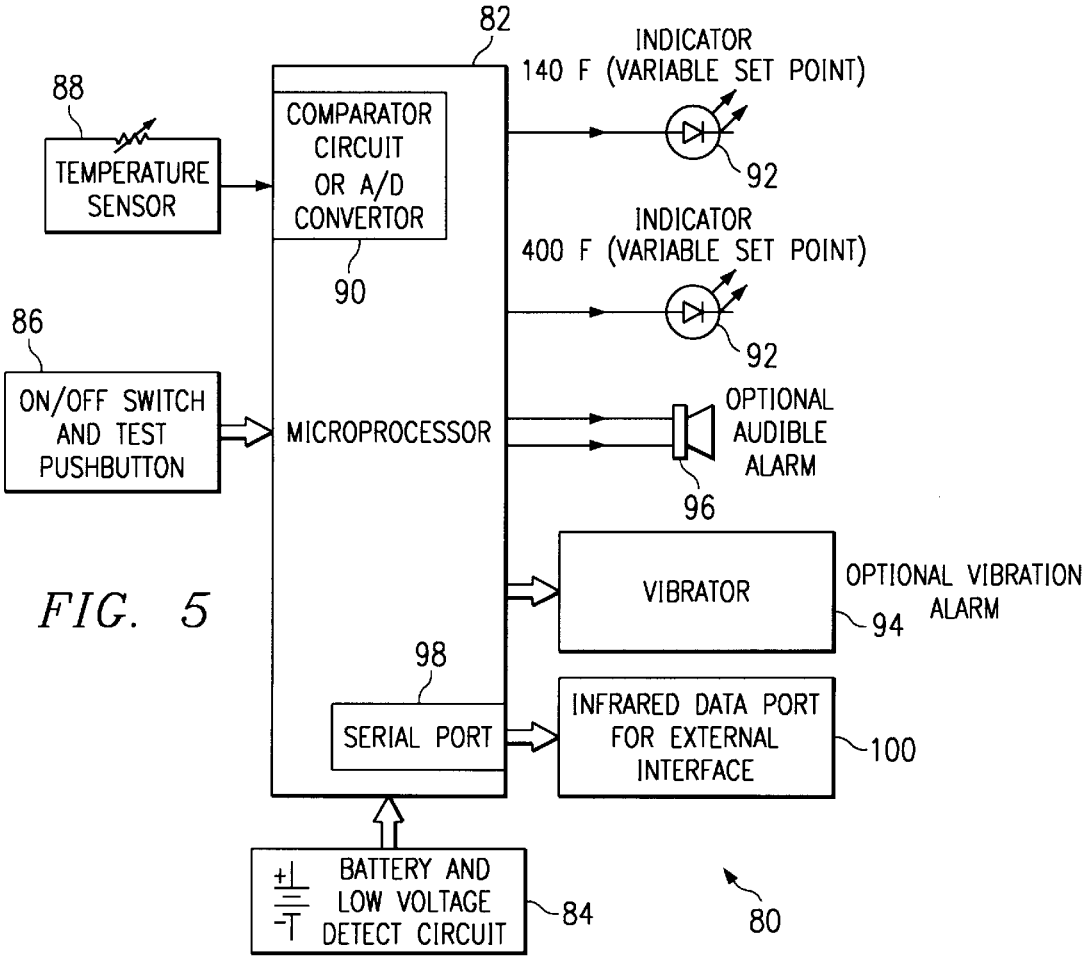
FIG. 5 is a block diagram of another embodiment of a system for alerting safety personnel of unsafe air temperature conditions.

FIG. 5 is a block diagram of another embodiment of a system, indicated generally at 80, for alerting safety personnel of unsafe air temperature conditions. As can be seen, system 80 is similar to system of FIG. 10 of FIG. 1. In the embodiment of FIG. 5, system 80 has a microprocessor 82 that receives power from a battery and low voltage detection circuit 84. Microprocessor 82 serves as a control unit for system 80, which could comprise alternate types of control devices as mentioned above. System 80 can be turned on and off by an on/off switch 86 which also can operate as a test push-button. A temperature sensor 88 measures temperature and provides an output to a comparator circuit or A/D converter 90 of microprocessor 82. Microprocessor 82 then provides signals to visible indicators 92 which have variable set points for indicating ambient temperature levels (e.g., 140° F. and 400° F.).

In operation, comparator circuit or A/D convertor 90 provides a signal to microprocessor 82 in response to a measurement by temperature sensor 88. Microprocessor 82 then provides signals to drive visible indicators 92. Further microprocessor 82 can provide signals to an optional vibration alarm 94 (e.g., mechanical motor, solenoid) and audible alarm 96. Further, microprocessor 82 comprises a serial port 98 which can output data to an infrared data port 100 for external interface to system 80. This could be user, for example, to recover a recorded temperature history or other pertinent information.

Figure 6A:
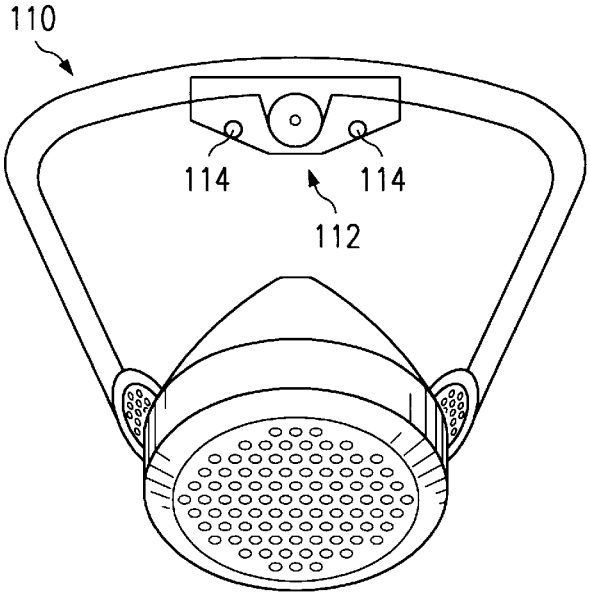
FIGS. 6A, 6B, 6C, 6D and 6E are diagrams of one embodiment of a through-screw sensor assembly for a system for alerting safety personnel of unsafe air temperature conditions constructed according to the present invention.
Figure 6B:
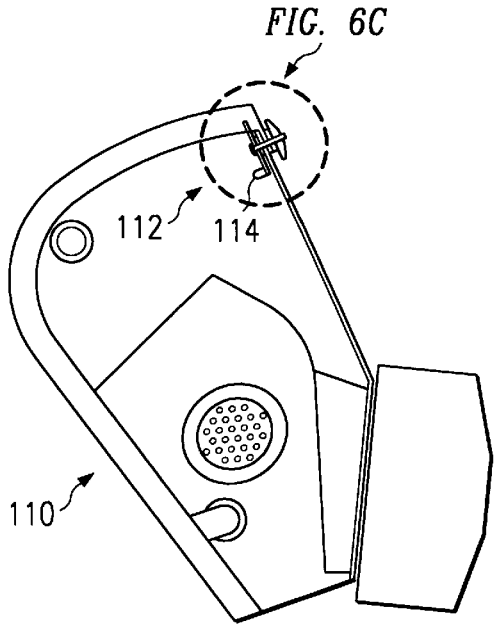

FIGS. 6A, 6B, 6C, 6D and 6E are diagrams of one embodiment of a through-screw sensor assembly for a system for alerting safety personnel of unsafe air temperature conditions constructed according to the present invention. As shown in FIG. 6A, a face mask 110 receives a through-screw sensor assembly, indicated generally at 112. Assembly 112 includes a pair of visible indicators 114 positioned within the range of vision of personnel wearing face mask 110. As can be seen, FIG. 6B is a side view of face mask 110. FIG. 6 also indicates an area shown in more detail in FIG. 6C.

Figure 6C:
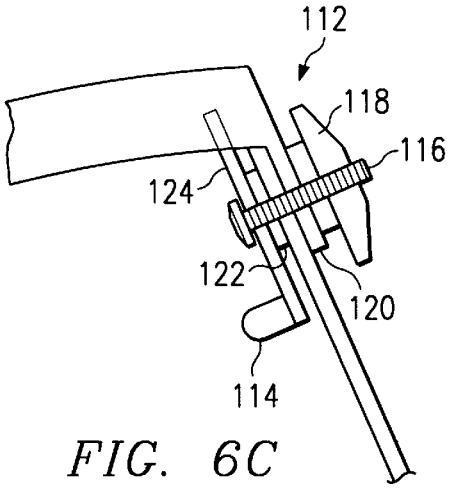
Figure 6E:
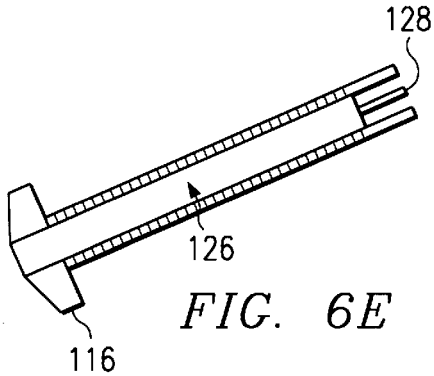
Figure 6D:
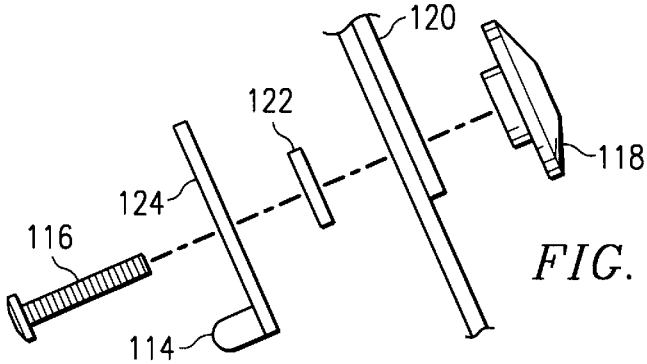

FIG. 6C provides a detailed view of assembly 112 affixed to face mask 110. As shown, assembly 112 comprises a hollow Allen head screw 116 which is coupled to fac mask 110. Assembly 112 further comprises a nut 118 positioned outside a front portion 120 of face mask 110 and a washer 122 position inside front portion 120. Together, screw 116, nut 118 and washer 122 removably attach to front portion 120. Further, these components also hold a circuit board 124 to which indicators 114 are connected. FIG. 6D provides an explosion view of these same components of assembly 112. In addition, FIG. 6E provides a cross section diagram of screw 116. As shown, screw 116 has a hollow center 126 which can provide a connection to a resistive temperature device (RTD) 128.

In operation, assembly 112 provides an advantageous means for mounting a sensor on face mask 110. In particular, assembly 112 is adapted to conventional face masks 110 which include a screw assembly for holding the visor. This screw assembly can easily be replaced by assembly 112 in installing the present invention.

Although the present invention has been described in detail, it should be understood that various changes, substitutions and alterations can be made hereto without departing from the spirit and scope of the invention as defined by the appended claims.

What is claimed is:

1. A system for alerting safety personnel of unsafe air temperature conditions, comprising:

a housing operable to be coupled to safety equipment associated with a view piece;

a temperature sensor formed to be exposed to an ambient environment, the temperature sensor operable to provide a signal representing a measured ambient temperature;

electronics operable to receive the signal from the temperature sensor, the electronics operable:

to process the signal from the temperature sensor;

to detect an unsafe temperature condition if the measured ambient temperature of air remains above a temperature set point for a specified period of time; and to provide an indicator signal responsive to the unsafe temperature condition;

an indicator coupled to receive the indicator signal from the electronics, the indicator responding to the indicator signal by providing a visible indication of the unsafe temperature condition; and an arm having first end coupled to the housing and a second end operable to be positioned within the ambient, the second end operable to be positioned at a distance away from the view piece at a viewable location associated with the view piece; and wherein the second end comprises the temperature sensor and the indicator.

2. The system of claim 1, wherein the temperature set point is adjustable.

3. The system of claim 2, wherein the electronics comprises:

a comparator circuit receiving the signal from the temperature sensor and comparing the signal with the temperature set point, the comparator circuit providing an output signal responsive to the comparison; and a microprocessor receiving the output signal of the comparator circuit and providing the indicator signal to the indicator.

4. The system of claim 3, further comprising:

a second indicator coupled to the microprocessor;

the comparator circuit further comparing the signal from the temperature sensor to a second temperature set point and providing a second output signal responsive to the result; and the microprocessor receiving the second output signal of the comparator circuit and providing a second indicator signal to the second indicator.

5. The system of claim 4, wherein the temperature set point is 300 degrees Fahrenheit.

6. The system of claim 5, wherein the second temperature set point is 600 degrees Fahrenheit.

7. The system of claim 1, wherein the electronics are further operable to calculate a time averaged temperature.

8. The system of claim 1, wherein the temperature sensor is coupled to the electronics by a through-screw sensor assembly.

9. The system of claim 1, wherein the electronics are further operable to record a temperature history.

10. The system of claim 1, further comprising an audible alarm coupled to the electronics, the electronics operable to activate the audible alarm responsive to the unsafe temperature condition.

11. The system of claim 1, further comprising a vibration alarm coupled to the electronics, the electronics operable to activate the vibration alarm responsive to the unsafe temperature condition.

12. A system for alerting safety personnel of unsafe air temperature conditions, comprising:

a housing formed to be attached to safety equipment associated with a view piece;

a microprocessor located in the housing;

a temperature sensor coupled to the housing and providing a signal representing a measured ambient temperature;

a comparator coupled to receive the signal from the temperature sensor, the comparator comparing the signal from the temperature sensor to a temperature set point, detecting an unsafe temperature condition if the measured ambient temperature remains above a temperature set point for a specified period of time, and providing a signal to the microprocessor based upon the unsafe temperature condition;

an arm having a first end coupled to the housing and a second end operable to be positioned within the ambient, the second end operable to be positioned at a distance away from the view piece at a viewable location associated with the view piece; and an indicator coupled to the second end of the arm, the indicator also coupled to receive a signal from the microprocessor representing the result of the comparison;

such that the indicator provides a visible indication of the unsafe temperature condition;

wherein the second end comprises the temperature sensor and the indicator.

13. The system of claim 12, further comprising:

a second indicator coupled to the second end of the arm;

the comparator further comparing the signal from the temperature sensor to a second temperature set point and providing a signal to the microprocessor based upon a result of the comparison; and the indicator coupled to receive a signal from the microprocessor representing the result of the comparison;

such that the second indicator provides a visible indication within the peripheral vision of the safety personnel when the measured ambient temperature is greater than the second temperature set point.

14. The system of claim 13, wherein the temperature set point is 300 degrees Fahrenheit and the second temperature set point is 600 degrees Fahrenheit.

15. The system of claim 12, wherein the temperature set point is 300 degrees Fahrenheit.

16. A method for alerting safety personnel of unsafe air temperature conditions, comprising:

measuring ambient temperature using a temperature sensor;

detecting an unsafe temperature condition when the measured ambient temperature exceeds a temperature set point for a specified period of time;

providing a visible indication of the unsafe temperature condition using an indicator; and wherein the indicator and temperature sensor are coupled to an arm, the arm operable to be positioned at a distance away from a view piece at a viewable location associated with the view piece.

17. The method of claim 16, wherein the temperature set point is adjustable.

18. The method of claim 16, further comprising calculating a time averaged temperature from the measured ambient temperature.

19. The method of claim 16, further comprising recording a temperature history based upon the measured ambient temperature.

20. The method of claim 16, further comprising activating an audible alarm responsive to the unsafe temperature condition.

21. The method of claim 16, further comprising activating a vibration alarm responsive to the unsafe temperature condition.

* * * * *